US010744774B2

(12) United States Patent
Matsui

(10) Patent No.: US 10,744,774 B2
(45) Date of Patent: Aug. 18, 2020

(54) INKJET RECORDING APPARATUS

(71) Applicant: KYOCERA Document Solutions Inc., Osaka (JP)

(72) Inventor: Shinya Matsui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/353,987

(22) Filed: Mar. 14, 2019

(65) Prior Publication Data

US 2019/0283432 A1 Sep. 19, 2019

(30) Foreign Application Priority Data

Mar. 15, 2018 (JP) ..... 2018-047895

(51) Int. Cl.

| | |
|---|---|
| ***B41J 2/165*** | (2006.01) |
| ***B41J 11/00*** | (2006.01) |
| ***B41J 2/045*** | (2006.01) |
| ***B41J 13/10*** | (2006.01) |
| ***B41J 13/00*** | (2006.01) |

(52) U.S. Cl.

CPC ..... *B41J 2/16579* (2013.01); *B41J 2/0451* (2013.01); *B41J 11/007* (2013.01); *B41J 13/009* (2013.01); *B41J 13/103* (2013.01); *B41J 13/106* (2013.01)

(58) Field of Classification Search

CPC .... B41J 2/16579; B41J 2/2139; B41J 2/2146; B41J 29/393

USPC ..... 347/14, 15, 19, 108

See application file for complete search history.

(56) References Cited

U.S. PATENT DOCUMENTS

| | | | | |
|---|---|---|---|---|
| 8,567,896 | B2 * | 10/2013 | Ueshima | B41J 2/04501 347/14 |
| 8,646,869 | B2 * | 2/2014 | Yamazaki | B41J 2/2135 347/19 |
| 9,056,463 | B2 * | 6/2015 | Sasayama | B41J 2/2142 |
| 2005/0063666 | A1 | 3/2005 | Takatsuka | |

FOREIGN PATENT DOCUMENTS

JP 2012166346 A 9/2012

OTHER PUBLICATIONS

An Office Action mailed by the State Intellectual Property Office of the People's Republic of China on Apr. 26, 2020, which corresponds to Chinese Patent Application No. 201910196007.8 and is related to U.S. Appl. No. 16/353,987 with English language translation.

* cited by examiner

*Primary Examiner* — An H Do

(74) *Attorney, Agent, or Firm* — Studebaker & Brackett PC

(57) ABSTRACT

An inkjet recording apparatus includes a recording head, a detection section, and a determination section. The recording head includes nozzles that eject ink onto a recording medium. The detection section detects ejection failure in a nozzle among the nozzles. The determination section determines a direction of the recording medium to be fed to the recording head based on a result of detection by the detection section and an image formed on the recording medium.

6 Claims, 9 Drawing Sheets

INKJET RECORDING APPARATUS

INCORPORATION BY REFERENCE

The present application claims priority under 35 U.S.C. § 119 to Japanese Patent Application No. 2018-047895, filed on Mar. 15, 2018. The contents of this application are incorporated herein by reference in their entirety.

BACKGROUND

The present disclosure relates to an inkjet recording apparatus.

An inkjet recording apparatus includes a recording head and a controller. The recording head ejects ink from nozzles onto a recording medium to form an image. The controller corrects line irregularity caused by ejection failure in a nozzle. That is, the controller corrects either raster image data or halftone image data to increase density of pixels corresponding to normal nozzles located around a nozzle failing in ink ejection.

SUMMARY

An inkjet recording apparatus according to the present disclosure includes a recording head, a detection section, and a determination section. The recording head includes nozzles that eject ink onto a recording medium. The detection section detects ejection failure in a nozzle among the nozzles. The determination section determines a direction of the recording medium to be fed to the recording head based on a result of detection by the detection section and an image formed on the recording medium.

DETAILED DESCRIPTION

Figure 1:
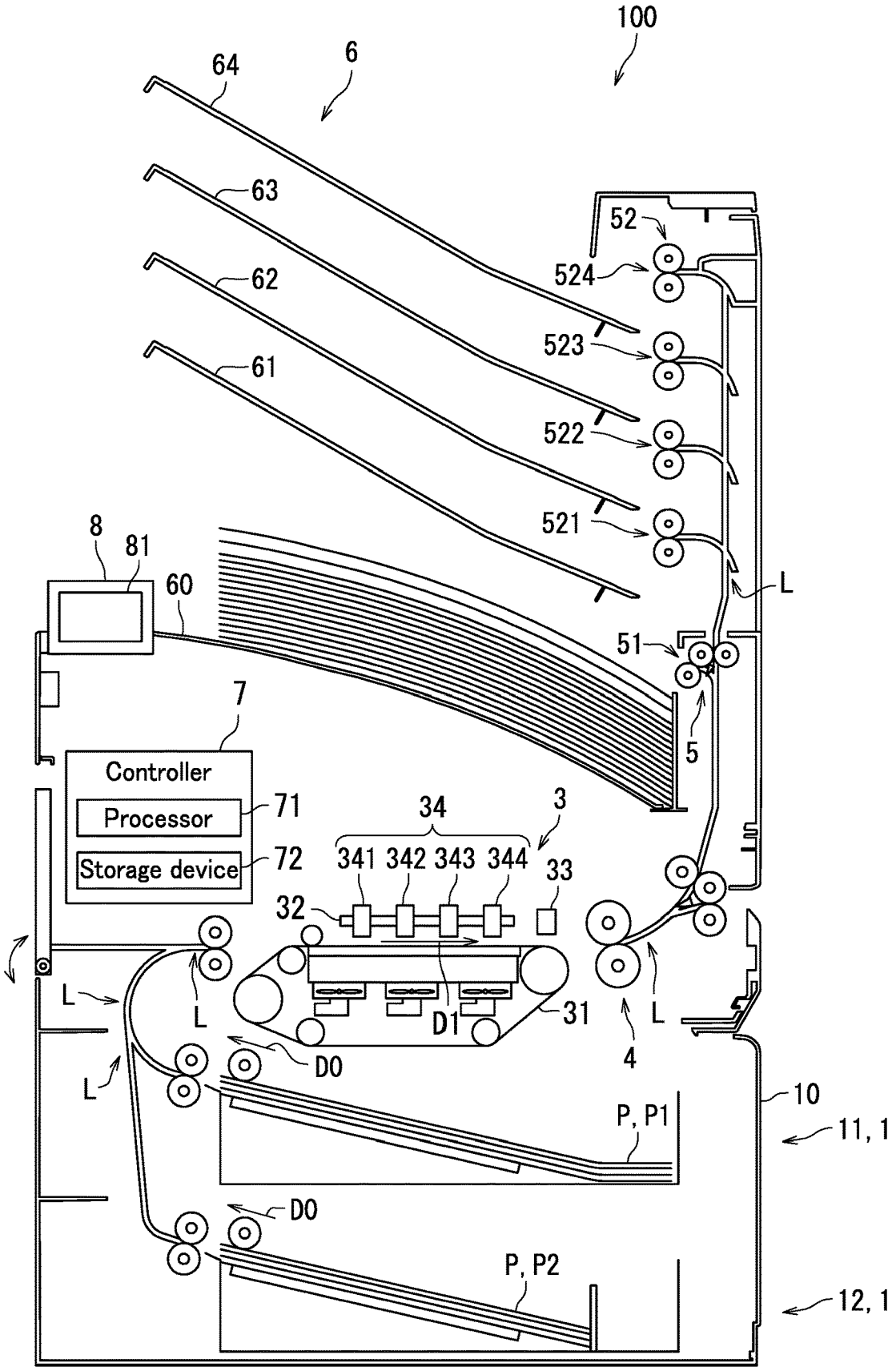
FIG. 1 is a diagram illustrating an example of a configuration of an inkjet recording apparatus according to an embodiment of the present disclosure.

The following describes an embodiment of the present disclosure with reference to the accompanying drawings (FIGS. 1 to 9). It should be noted that elements in the drawings that are the same or equivalent are labelled using the same reference signs and description thereof is not repeated.

An inkjet recording apparatus 100 according to the present embodiment will be described first with reference to FIG. 1. FIG. 1 is a diagram illustrating a configuration of the inkjet recording apparatus 100. As illustrated in FIG. 1, the inkjet recording apparatus 100 includes a casing 10, a feeding section 1, an image forming section 3, a sheet conveyance section L, an ejection section 5, exit trays 6, a controller 7, and an operation panel 8. The casing 10 accommodates the feeding section 1, the image forming section 3, the sheet conveyance section L, the ejection section 5, and the controller 7.

The feeding section 1 feeds sheets P one at a time to the sheet conveyance section L in a feeding direction D0. The feeding direction D0 is a direction in which the feeding section 1 feeds a sheet P to the sheet conveyance section L. The feeding section 1 includes a first feeding cassette 11 and a second feeding cassette 12. The sheets P include first sheets P1 and second sheets P2. The first feeding cassette 11 accommodates the first sheets P1 and is attachable to and detachable from the casing 10. The second feeding cassette 12 accommodates the second sheets P2 and is attachable to and detachable from the casing 10.

The second sheets P2 have the same size as the first sheets P1. For example, each of the first sheets P1 and the second sheets P2 is an A4 sheet defined in International Organization for Standardization (ISO) 216. Each sheet P corresponds to an example of a "recording medium". The first and second feeding cassettes 11 and 12 correspond to examples of "feeding trays". The first feeding cassette 11 corresponds to an example of a "second tray". The second feeding cassette 12 corresponds to an example of a "first tray".

The first sheets P1 are loaded in the first feeding cassette 11 such that the long sides of the first sheets P1 are parallel to the feeding direction D0 of a sheet P. The second sheets P2 are loaded in the second feeding cassette 12 such that the short sides of the second sheets P2 are parallel to the feeding direction D0.

The sheet conveyance section L feeds the sheet P to the image forming section 3. The sheet conveyance section L includes feeding rollers 4. The sheet conveyance section L conveys the sheet P forwarded from the image forming section 3 to the ejection section 5. Specifically, the feeding rollers 4 convey the sheet P forwarded from the image forming section 3 to the ejection section 5. The feeding rollers 4 are located between the image forming section 3 and the ejection section 5.

The image forming section 3 forms an image on the sheet P. The image forming section 3 includes a conveyor belt 31, a head base 32, a contact image sensor (CIS) unit 33, and a recording head unit 34.

The conveyor belt 31 conveys the sheet P fed from the sheet conveyance section L in a conveyance direction D1 of the sheet P. The conveyance direction D1 is a direction in which the conveyor belt 31 conveys the sheet P. The conveyor belt 31 corresponds to an example of a "conveyance section".

The conveyor belt 31 conveys a first sheet P1 in a manner that the long sides of the first sheet P1 are parallel to the conveyance direction D1. The first sheet P1 is fed from the first feeding cassette 11. The conveyor belt 31 also conveys a second sheet P2 in a manner that the short sides of the second sheet P2 are parallel to the conveyance direction D1. The second sheet P2 is fed from the second feeding cassette 12. That is, an angle between a direction of the first sheet P1 fed from the first feeding cassette 11 to the recording head unit 34 and a direction of the second sheet P2 fed from the second feeding cassette 12 to the recording head unit 34 is 90 degrees.

The recording head unit 34 includes a plurality of nozzles and forms an image on the sheet P by ejecting ink from the nozzles onto the sheet P. The recording head unit 34 includes a first recording head 341, a second recording head 342, a third recording head 343, and a fourth recording head 344. The first recording head 341 contains a yellow ink Ky. The second recording head 342 contains a black ink Kk. The third recording head 343 contains a cyan ink Kc. The fourth recording head 344 contains a magenta ink Km.

The head base 32 supports the first to fourth recording heads 341 to 344. The head base 32 is in a flat plate shape. The head base 32 is disposed substantially horizontally.

The CIS unit 33 is disposed downstream of the recording head unit 34 in the conveyance direction D1 of the sheet P. The CIS unit 33 is located between the recording head unit 34 and the feeding rollers 4 in the conveyance direction D1. The CIS unit 33 reads an image M formed on the sheet P, and generates image information MJ representing the image M. The CIS unit 33 includes light emitting diodes (LEDs), an imaging lens, and an image sensor. The CIS unit 33 corresponds to an example of an "image information generating section".

The ejection section 5 is disposed downstream of the image forming section 3 in the conveyance direction D1 of the sheet P. The ejection section 5 ejects the sheet P out of the casing 10. The ejection section 5 includes a main body ejection section 51 and an upper ejection section 52. The upper ejection section 52 is located above the main body ejection section 51. The upper ejection section 52 includes a first ejection section 521, a second ejection section 522, a third ejection section 523, and a fourth ejection section 524. The second ejection section 522 is located above the first ejection section 521. The third ejection section 523 is located above the second ejection section 522. The fourth ejection section 524 is located above the third ejection section 523.

The sheet P ejected out of the ejection section 5 is put on any of the exit trays 6. The exit trays 6 include a main body exit tray 60, a first exit tray 61, a second exit tray 62, a third exit tray 63, and a fourth exit tray 64. The first exit tray 61 is located above the main body exit tray 60. The second exit tray 62 is located above the first exit tray 61. The third exit tray 63 is located above the second exit tray 62. The fourth exit tray 64 is located above the third exit tray 63. The main body exit tray 60 and the first to fourth exit trays 61 to 64 correspond to examples of "exit trays".

The main body ejection section 51 ejects the sheet P onto the main body exit tray 60. The first ejection section 521 ejects the sheet P onto the first exit tray 61. The second ejection section 522 ejects the sheet P onto the second exit tray 62. The third ejection section 523 ejects the sheet P onto the third exit tray 63. The fourth ejection section 524 ejects the sheet P onto the fourth exit tray 64.

The controller 7 includes a processor 71 and a storage device 72. The processor 71 includes for example a central processing unit (CPU). The storage device 72 includes memory such as semiconductor memory and may include a hard disk drive (HDD). The storage device 72 stores control programs therein.

The operation panel 8 includes a touch panel 81. The touch panel 81 includes a display and a touch sensor. The display includes for example a liquid crystal display (LCD) and displays various images. The touch sensor receives user operation. The touch sensor is disposed for example on a display surface of the display. The touch panel 81 corresponds to an example of a "display".

Figure 2:
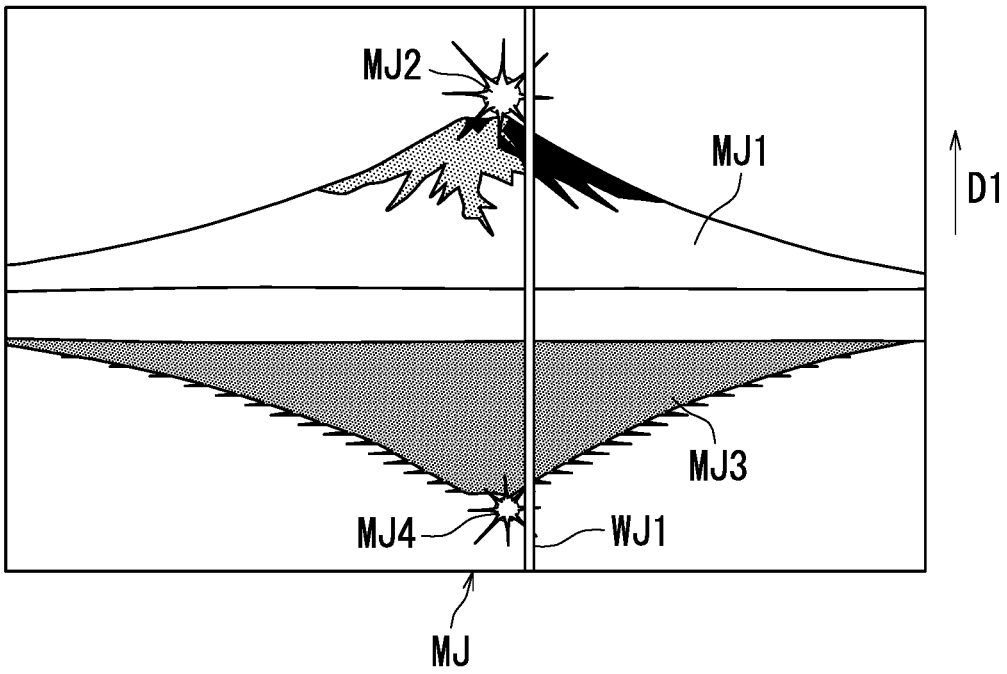
FIG. 2 is a diagram illustrating an example of image information indicating an image formed when ejection failure in a nozzle occurs.

The following describes the image M formed when ejection failure in a nozzle occurs with reference to FIGS. 1 and 2. FIG. 2 is a diagram illustrating an example of the image information MJ indicating the image M formed when ejection failure in a nozzle occurs. The embodiment of the present disclosure describes a case where the image M is a monochrome image. Further, the image M is formed on the second sheet P2. The second sheet P2 is fed from the second feeding cassette 12 to the recording head unit 34 as illustrated in FIG. 1.

As illustrated in FIG. 2, the image information MJ contains first mountain image information MJ1, first sun image information MJ2, second mountain image information MJ3, second sun image information MJ4, and void image information WJ1. The image information MJ is information indicating an image of a so-called "Diamond Fuji". Diamond Fuji is an optical phenomenon that occurs when the mountaintop of Mt. Fuji and the sun overlap with each other.

The first mountain image information MJ1 indicates an image of Mt. Fuji. The first sun image information MJ2 indicates an image of the sun. The second mountain image information MJ3 indicates an image of Mt. Fuji reflected on the surface of a lake. The second sun image information MJ4 indicates an image of the sun reflected on the surface of the lake.

The void image information WJ1 indicates a void image W1 in a linear shape parallel to the second sheet P2, that is, parallel to the conveyance direction D1 of the sheet P. The void image information WJ1 is generated on a location corresponding to a position of a nozzle failing in ink ejection in a situation in which ejection failure in the nozzle occurs.

The void image information WJ1 overlaps with each of the first mountain image information MJ1, the first sun image information MJ2, the second mountain image information MJ3, and the second sun image information MJ4. That is, in a situation in which ejection failure in a nozzle occurs, a void is created in each of the first mountain image information MJ1, the first sun image information MJ2, the second mountain image information MJ3, and the second sun image information MJ4.

Figure 3:
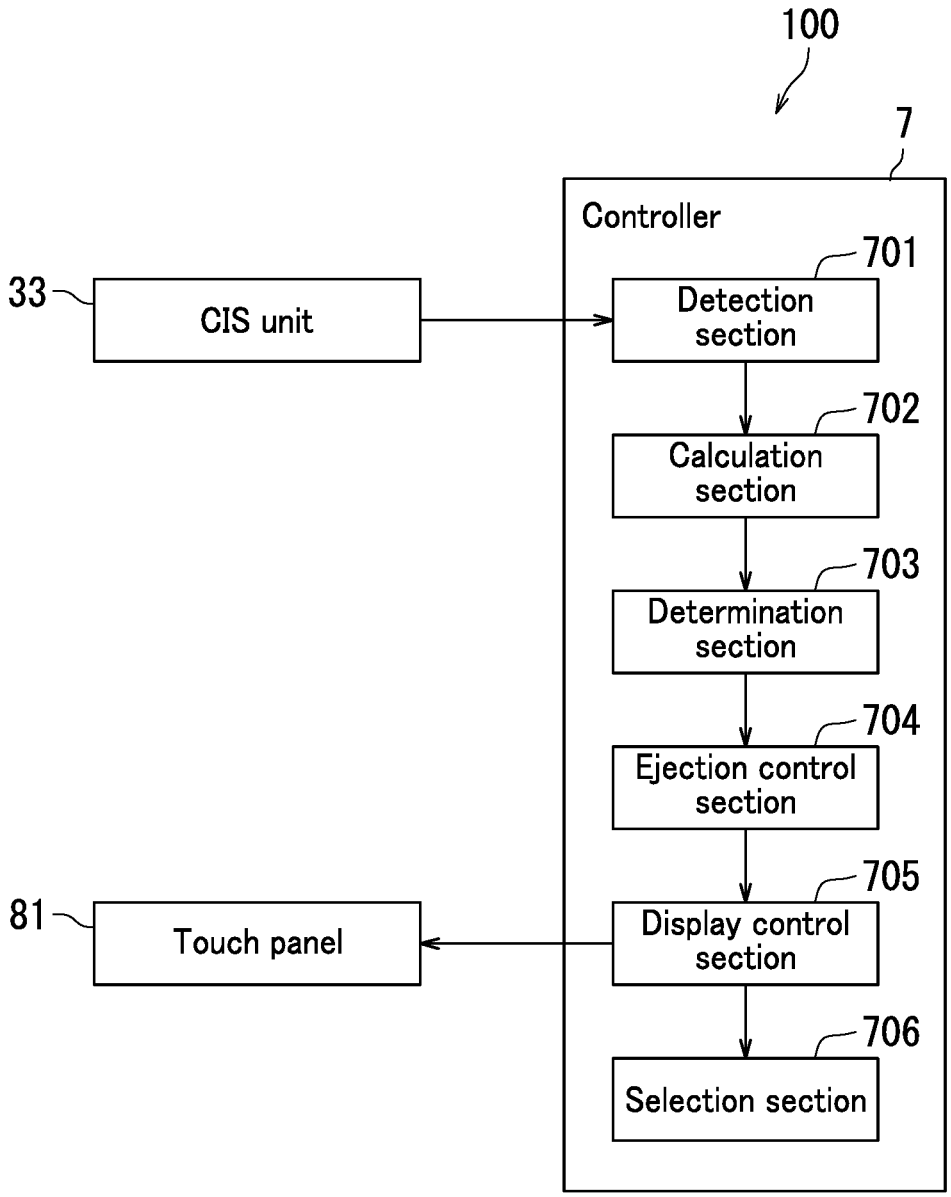
FIG. 3 is a diagram illustrating an example of a configuration of a controller of the inkjet recording apparatus according to the embodiment of the present disclosure.

The following describes a configuration of the controller 7 according to the embodiment of the present disclosure with reference to FIGS. 1 to 3. FIG. 3 is a diagram illustrating an example of the configuration of the controller 7. As illustrated in FIG. 3, the controller 7 includes a detection section 701, a calculation section 702, a determination section 703, an ejection control section 704, a display control section 705, and a selection section 706. Specifically, the controller 7 functions as the detection section 701, the calculation section 702, the determination section 703, the ejection control section 704, the display control section 705, and the selection section 706 through the processor 71 of the controller 7 executing the control programs.

The detection section 701 detects ejection failure in a nozzle. Specifically, the detection section 701 acquires the image information MJ generated by the CIS unit 33 and detects ejection failure in a nozzle based on the image information MJ. More specifically, the detection section 701 detects whether or not the image information MJ contains the void image information WJ1 indicating an image of a linear void parallel to the conveyance direction D1 as illustrated in FIG. 2. When the image information MJ contains the void image information WJ1, the detection section 701 detects ejection failure in a nozzle.

The calculation section 702 calculates a pixel count NW of pixels corresponding to the nozzle for which ejection failure is detected by the detection section 701 among pixels in the image information MJ representing the image M formed on the sheet P. The calculation section 702 will be described later in detail with reference to FIGS. 4 and 5.

The determination section 703 determines a direction of the sheet P to be fed to the recording head unit 34 based on a result of detection by the detection section 701 and the image M formed on the sheet P. Specifically, the determination section 703 determines the direction of the sheet P to be fed to the recording head unit 34 based on the pixel count NW calculated by the calculation section 702. The determination section 703 will be described later in detail with reference to FIGS. 4 and 5.

The ejection control section 704 controls the ejection section 5 to eject the sheet P with the image M formed thereon onto any one exit tray 6S of the main body exit tray 60 and the first to fourth exit trays 61 to 64 according to the direction of the sheet P determined by the determination section 703. Accordingly, the ejection section 5 ejects the sheet P with the image M formed thereon onto any one exit tray 6S of the main body exit tray 60 and the first to fourth exit trays 61 to 64 according to the direction of the sheet P determined by the determination section 703. Specifically, the ejection control section 704 controls the ejection section 5 to select one exit tray 6S from among the main body exit tray 60 and the first to fourth exit trays 61 to 64 according to the direction of the sheet P determined by the determination section 703. Accordingly, the ejection section 5 selects one exit tray 6S from among the main body exit tray 60 and the first to fourth exit trays 61 to 64 according to the direction of the sheet P determined by the determination section 703. The ejection control section 704 then controls the ejection section 5 to eject the sheet P with the image M formed thereon onto the selected exit tray 6S. The ejection control section 704 will be described later in detail with reference to FIGS. 4 and 5.

The display control section 705 causes the touch panel 81 to display information indicating the sheet P with the image M formed thereon in association with information indicating the one exit tray 6S onto which the sheet P is to be ejected. The display control section 705 will be described later in detail with reference to FIG. 6.

The selection section 706 selects one feeding cassette 1S from among the first feeding cassette 11 and the second feeding cassette 12. The feeding cassette 1S is a feeding cassette that feeds the sheet P. The selection section 706 will be described later in detail with reference to FIGS. 4 and 5.

According to the embodiment of the present disclosure as described with reference to FIGS. 1 to 3, ejection failure in a nozzle is detected and the direction of the sheet P to be fed to the recording head unit 34 is determined based on a result of the detection and the image M formed on the sheet P. In the above configuration, the direction of the sheet P in which the image M is to be formed on the sheet P favorably in quality can be determined in a situation in which ejection failure in a nozzle occurs. Consequently, quality impairment of the image M formed on the sheet P can be reduced.

The CIS unit 33 reads the image formed on the sheet P and generates the image information MJ representing the image M. Ejection failure in a nozzle is then detected based on the image information MJ. When ejection failure in a nozzle occurs, the linear void image W1 (a part of the image M formed on the sheet P to which no ink adheres) is formed at a location of the image M that corresponds to the nozzle failing in ink ejection. Therefore, ejection failure in a nozzle can be accurately detected.

The CIS unit 33 is disposed downstream of the recording head unit 34 in the conveyance direction D1 of the sheet P. In the above configuration, it is possible to read the image M formed on the sheet P directly after the image M is formed by the recording head unit 34 and to generate the image information MJ representing the image M. Therefore, ejection failure in a nozzle can be detected in an early stage.

Furthermore, the pixel count NW of pixels corresponding to the nozzle for which ejection failure is detected is calculated from the image information MJ representing the image M formed on the sheet P and the direction of the sheet P to be fed to the recording head unit 34 is determined based on the pixel count NW. For example, the direction of the sheet P is determined to be a direction in which the pixel count NW of pixels corresponding to the nozzle for which ejection failure is detected is minimum. In the above configuration, the direction of the sheet P in which the image M is to be formed on the sheet P favorably in quality can be determined. Thus, quality impairment of the image M formed on the sheet P can be reduced.

Figure 4A:
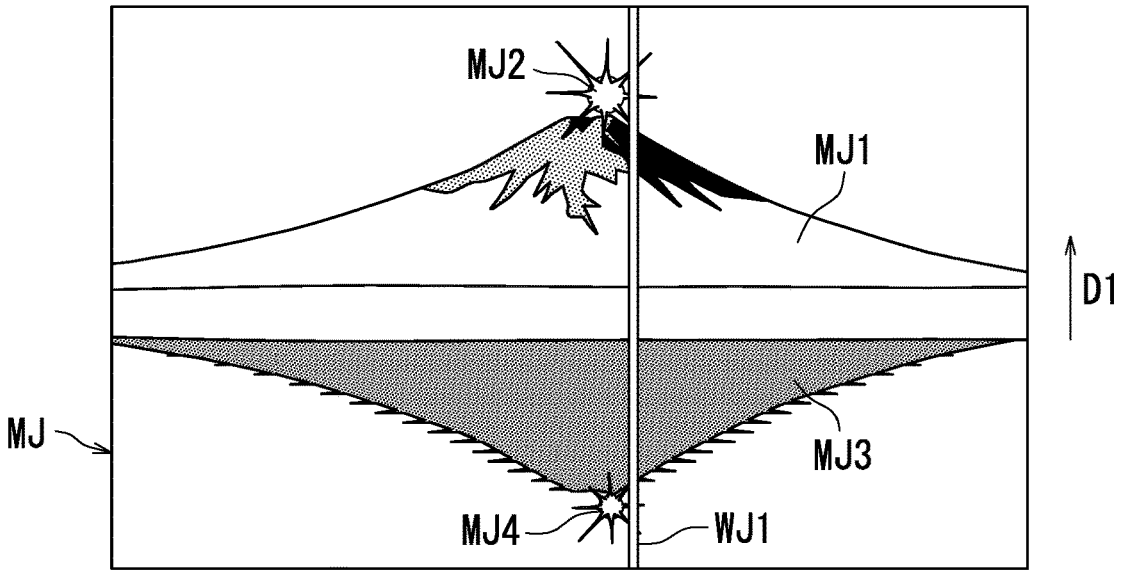
FIG. 4A is a diagram illustrating an example of image information indicating an image to be formed where a rotation angle of a sheet is 0 degrees.
Figure 4B:
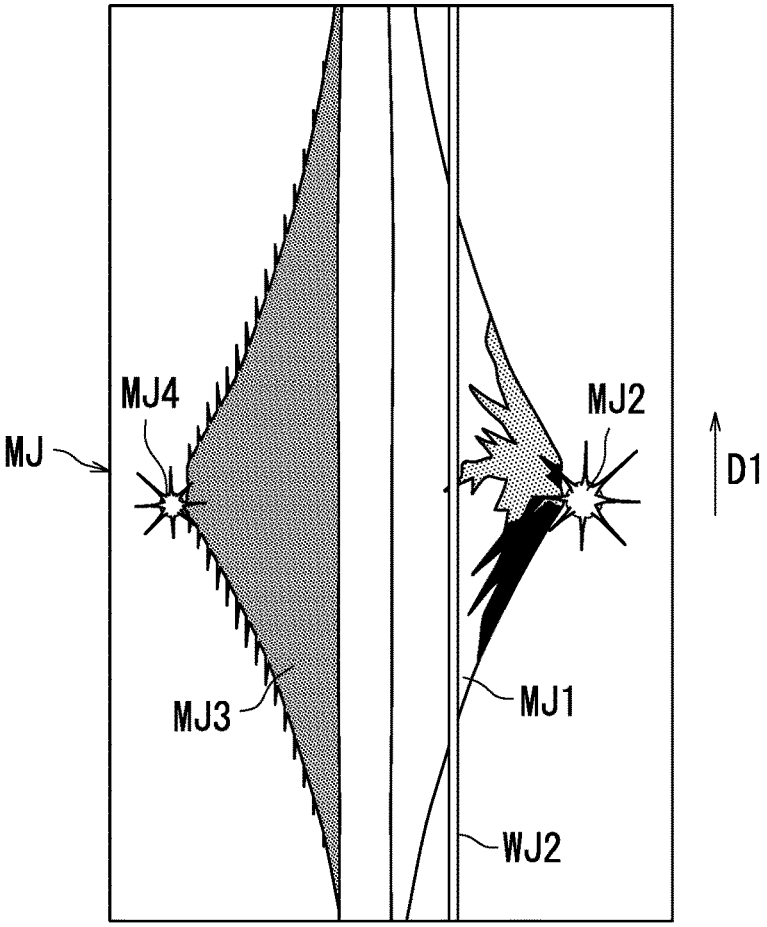
FIG. 4B is a diagram illustrating an example of image information indicating an image to be formed where the rotation angle of the sheet is 90 degrees.
Figure 5A:
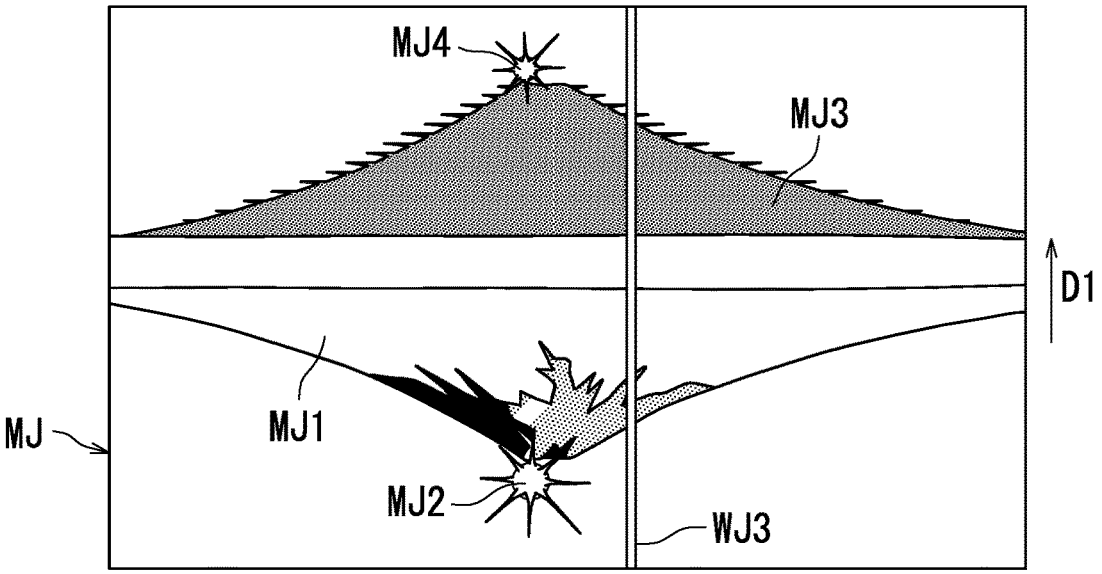
FIG. 5A is a diagram illustrating an example of image information indicating an image to be formed where the rotation angle of the sheet is 180 degrees.
Figure 5B:
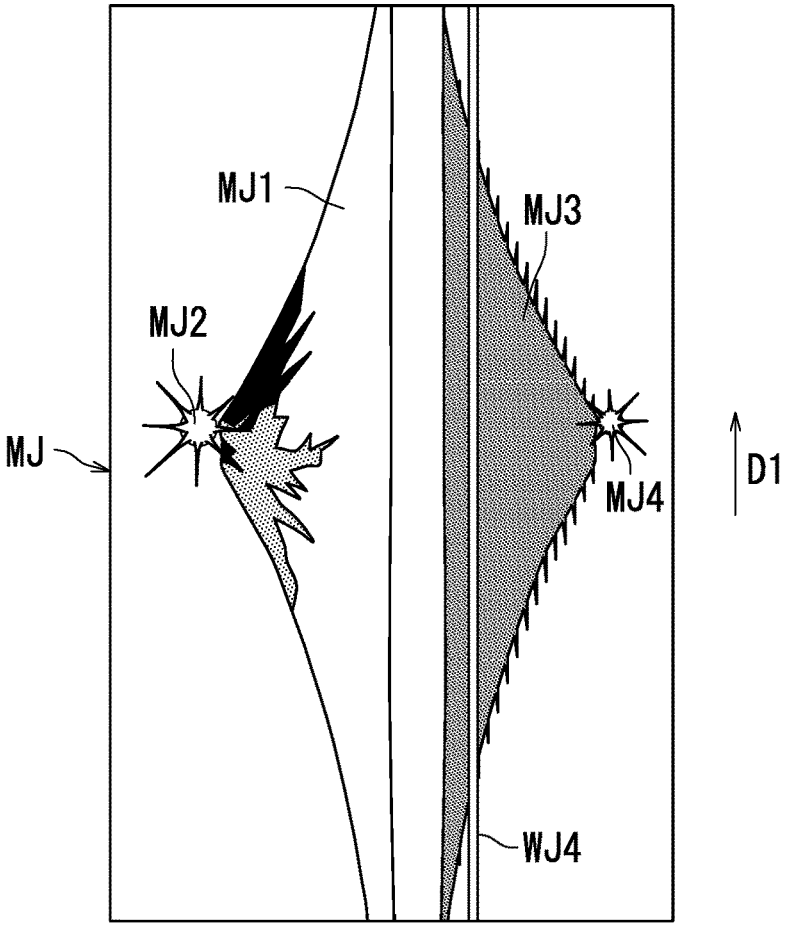
FIG. 5B is a diagram illustrating an example of image information indicating an image to be formed where the rotation angle of the sheet is 270 degrees.

The following further describes a process performed by the controller 7 with reference to FIGS. 1 to 5B. FIGS. 4A, 4B, 5A, and 5B are diagrams each illustrating an example of the image M to be formed in a case where ejection failure in a nozzle occurs. FIG. 4A is a diagram illustrating an example of the image information MJ indicating the image M to be formed when an angle θ of rotation of the sheet P is 0 degrees. FIG. 4B is a diagram illustrating an example of the image information MJ indicating the image M to be formed when the angle θ of rotation of the sheet P is 90 degrees. FIG. 5A is a diagram illustrating an example of the image information MJ indicating the image M to be formed when the angle θ of rotation of the sheet P is 180 degrees. FIG. 5B is a diagram illustrating an example of the image information MJ indicating the image M to be formed when the angle θ of rotation of the sheet P is 270 degrees.

The angle θ of rotation is a clockwise angle of rotation of the sheet P fed to the recording head unit 34 relative to a direction of the sheet P for which ejection failure is detected. The sheet P for which ejection failure is detected is a sheet P on which the image M has been formed in a situation in which the detection section 701 detects ejection failure in a nozzle. When the sheet P is rotated by an angle θ of rotation, the image information MJ indicating the image M formed on the sheet P is also rotated by the angle θ of rotation.

Referring to FIG. 4A, the angle θ of rotation of the sheet P is 0 degrees, and therefore, the image information MJ illustrated in FIG. 4A agrees with the image information MJ illustrated in FIG. 2. That is, as illustrated in FIG. 4A, the void image information WJ1 overlaps with the first mountain image information MJ1, the first sun image information MJ2, the second mountain image information MJ3, and the second sun image information MJ4. In other words, a void is created in each of the first mountain image information MJ1, the first sun image information MJ2, the second mountain image information MJ3, and the second sun image information MJ4.

The calculation section 702 calculates a pixel count NW1 under a condition that the angle θ of rotation of the sheet P is 0 degrees. The pixel count NW1 is a pixel count NW of pixels corresponding to the nozzle for which ejection failure is detected under a condition that the angle θ of rotation of the sheet P is 0 degrees. The pixel count NW1 is also a pixel count NW of the pixels corresponding to the nozzle for which ejection failures is detected in the image information MJ representing the image M formed on the sheet P. Specifically, the calculation section 702 calculates a pixel count NW11 of pixels among pixels in the first mountain image information MJ1 in which a void is created due to overlap with the void image information WJ1. The calculation section 702 also calculates a pixel count NW12 of pixels among pixels in the first sun image information MJ2 in which a void is created due to overlap with the void image information WJ1. The calculation section 702 further calculates a pixel count NW13 of pixels among pixels in the second mountain image information MJ3 in which a void is created due to overlap with the void image information WJ1. The calculation section 702 additionally calculates a pixel count NW14 of pixels among pixels in the second sun image information MJ4 in which a void is created due to overlap with the void image information WJ1. The calculation section 702 calculates the pixel count NW1 using the following formula (1).

$$NW1=NW11+NW12+NW13+NW14 \quad (1)$$

A density value is set for each pixel constituting the image information MJ. The density value is for example at least 0 and not greater than 255. A pixel having a density value of "0" is a white pixel. A pixel having a density value of "255" is a black pixel. A pixel having a density value of at least 1 and not greater than 254 is a gray pixel. The calculation section 702 calculates a count of pixels among pixels constituting the image information MJ that each have a density value of at least a specific threshold value and that overlap with the void image information WJ1. The threshold value is for example "50".

The calculation section 702 also calculates a pixel count NW2 under a condition that the angle θ of rotation of the sheet P is 90 degrees. The pixel count NW2 is a pixel count NW of pixels corresponding to the nozzle for which ejection failure is detected under a condition that the angle θ of rotation of the sheet P is 90 degrees. The pixel count NW2 is also a pixel count NW of pixels that each have a density value of at least the specific threshold value and that correspond to the nozzle for which ejection failure is detected in the image information MJ representing the image M formed on the sheet P. When the angle θ of rotation of the sheet P is 90 degrees, a void image W2 in a linear shape represented by void image information WJ2 is formed in parallel to the conveyance direction D1 of the sheet P, as illustrated in FIG. 4B. The void image information WJ2 overlaps with the first mountain image information MJ1. That is, a void is contained in the first mountain image information MJ1. No void is contained in any of the first sun image information MJ2, the second mountain image information MJ3, and the second sun image information MJ4.

Specifically, the calculation section 702 calculates a pixel count NW21 of pixels among the pixels in the first mountain image information MJ1 in which a void is created due to overlap with the void image information WJ1. The calculation section 702 calculates the pixel count NW2 using the following formula (2).

$$NW2=NW21 \quad (2)$$

The calculation section 702 also calculates a pixel count NW3 under a condition that the angle θ of rotation of the sheet P is 180 degrees. The pixel count NW3 is a pixel count NW of pixels corresponding to the nozzle for which ejection failure is detected under a condition that the angle θ of rotation of the sheet P is 180 degrees. The pixel count NW3 is also a pixel count NW of pixels that each have a density value of at least the specific threshold value and that correspond to the nozzle for which ejection failure is detected in the image information MJ representing the image M formed on the sheet P. When the angle θ of rotation of the sheet P is 180 degrees, a void image W3 in a linear shape represented by void image information WJ3 is formed in parallel to the conveyance direction D1 of the sheet P, as illustrated in FIG. 5A. The void image information WJ3 overlaps with each of the first mountain image information MJ1 and the second mountain image information MJ3. That is, a void is contained in each of the first mountain image information MJ1 and the second mountain image information MJ3. No void is contained in either the first sun image information MJ2 or the second sun image information MJ4.

Specifically, the calculation section 702 calculates a pixel count NW31 of pixels among the pixels in the first mountain image information MJ1 in which a void is created due to overlap of the first mountain image information MJ1 with the void image information WJ3. The calculation section 702 further calculates a pixel count NW33 of pixels among pixels in the second mountain image information MJ3 in which a void is created due to overlap with the void image information WJ3. The calculation section 702 calculates the pixel count NW3 using the following formula (3).

$$NW3=NW31+NW33 \quad (3)$$

The calculation section 702 also calculates a pixel count NW4 under a condition that the angle θ of rotation of the sheet P is 270 degrees. The pixel count NW4 is a pixel count NW of pixels corresponding to the nozzle for which ejection failure is detected under a condition that the rotation angle θ of the sheet P is 270 degrees. The pixel count NW4 is also a pixel count NW of pixels that each have a density value of at least the specific threshold value and that correspond to the nozzle for which ejection failure is detected in the image information MJ representing the image M formed on the sheet P. When the rotation angle θ of the sheet P is 270 degrees, a void image W4 in a linear shape represented by void image information WJ4 is formed in parallel to the conveyance direction D1 of the sheet P, as illustrated in FIG. 5B. The void image information WJ4 overlaps with the second mountain image information MJ3. That is, a void is contained in the second mountain image information MJ3. None of the first mountain image information MJ1, the first sun image information MJ2, or the second sun image information MJ4 contain a void.

Specifically, the calculation section 702 calculates a pixel count NW43 of pixels among the pixels in the second mountain image information MJ3 that form a void due to overlap with the void image information WJ4. The calculation section 702 calculates the pixel count NW4 using the following formula (4).

$$NW4=NW43 \quad (4)$$

The determination section 703 determines as the direction of the sheet P a direction indicated by the angle θ of rotation corresponding to a pixel count NW0 that is the smallest pixel count of the four pixel counts NW1 to NW4 calculated by the calculation section 702. The determination section 703 determines for example the direction of the sheet P where the angle θ of rotation of the sheet P is 90 degrees as illustrated in FIG. 4B.

The ejection control section 704 controls the ejection section 5 to select one exit tray 6S from among the main body exit tray 60 and the first to fourth exit trays 61 to 64 according to the direction of the sheet P determined by the determination section 703. Accordingly, the ejection section 5 selects one exit tray 6S from among the main body exit tray 60 and the first to fourth exit trays 61 to 64 according to the direction of the sheet P determined by the determination section 703. For example, when the determination section 703 determines as the direction of the sheet P a direction corresponding to an angle θ of rotation of 0 degrees, the ejection control section 704 selects the main body exit tray 60 as the exit tray 6S. Alternatively, when the determination section 703 determines as the direction of the sheet P a direction corresponding to an angle θ of rotation of 90 degrees, the ejection control section 704 selects the first exit tray 61 as the exit tray 6S. When the determination section 703 determines as the direction of the sheet P a direction corresponding to an angle θ of rotation of 180 degrees, the ejection control section 704 selects the second exit tray 62 as the exit tray 6S. When the determination section 703 determines as the direction of the sheet P a direction corresponding to an angle θ of rotation of 270 degrees, the ejection control section 704 selects the third exit tray 63 as the exit tray 6S. The ejection control section 704 then controls the ejection section 5 to eject the sheet P with the image M formed thereon onto the exit tray 6S selected by the ejection control section 704.

When the determination section 703 determines as the direction of the sheet P a direction corresponding to an angle θ of rotation of 0 degrees or 180 degrees, the selection section 706 selects the second feeding cassette 12 as the feeding cassette 1S. When the determination section 703 determines as the direction of the sheet P a direction corresponding to an angle θ of rotation of 90 degrees or 270 degrees, the selection section 706 selects the first feeding cassette 11 as the feeding cassette 1S. The controller 7 causes the sheet P to be fed to the recording head unit 34 from the feeding cassette 1S selected by the selection section 706.

According to the embodiment of the present disclosure as described with reference to FIGS. 1 to 5, calculation is performed to obtain the pixel count NW1 under a condition that the angle θ of rotation of the sheet P is 0 degrees, the pixel count NW2 under a condition that the angle θ of rotation is 90 degrees, the pixel count NW3 under a condition that the angle θ of rotation is 180 degrees, and the pixel count NW4 under a condition that the angle θ of rotation is 270 degrees. Each of the pixel counts NW1 to NW4 is a pixel count of pixels corresponding to the nozzle for which ejection failure is detected. A direction represented by the rotation angle θ corresponding to the smallest pixel count NW0 of the calculated four pixel counts NW1 to NW4 is determined as the direction of the sheet P. In the above configuration, a direction of the sheet P in which the image M is to be formed on the sheet P favorably in quality can be determined. Thus, quality impairment of the image M formed on the sheet P can be reduced.

Furthermore, one exit tray 6S is selected from among the main body exit tray 60 and the first to fourth exit trays 61 to 64 according to the determined direction of the sheet P and the sheet P with the image M formed thereon is ejected onto the selected exit tray 6S. In the above configuration, a situation in which sheets P different in direction are put on the one exit tray 6S can be prevented. Consequently, user convenience can be increased.

Furthermore, as described with reference to FIG. 1, the angle between the direction of the first sheet P1 fed from the first feeding cassette 11 and the direction of the second sheet P2 fed from the second feeding cassette 12 is 90 degrees. Therefore, when a direction indicated by an angle θ of rotation of 0 degrees or 180 degrees is determined as the direction of the sheet P, the second feeding cassette 12 is selected as the feeding cassette 1S. When a direction indicated by an angle θ of rotation of 90 degrees or 270 degrees is determined as the direction of the sheet P, the first feeding cassette 11 is selected as the feeding cassette 1S. Thus, the feeding cassette 1S according to the direction of the sheet P can be selected.

Note that the calculation section 702 in the embodiment of the present disclosure calculates a count of pixels among the pixels constituting the image information MJ that each have a density value of at least the specific threshold value and that overlap with the void image information WJ1, which should not be taken to limit the present disclosure. The calculation section 702 may calculate a sum of density values of pixels among the pixels constituting the image information MJ that overlap with the void image information WJ1. In such a case, the determination section 703 determines as the direction of the sheet P a direction indicated by an angle θ of rotation corresponding to the smallest sum of four sums of the density values calculated by the calculation section 702. In the above case, the direction of the sheet P can be determined so that quality of the image M formed on the sheet P is furthermore favorable. Consequently, quality impairment of the image M formed on the sheet P can be further reduced.

Moreover, the calculation section 702 in the embodiment of the present disclosure calculates a count of pixels among the pixels constituting the image information MJ that each have a density value of at least the specific threshold value and that overlap with the void image information WJ1, which should not be taken to limit the present disclosure. It is only required that the calculation section 702 calculate a count of pixels that overlap with the void image information WJ1. For example, the calculation section 702 may calculate a count of pixels among the pixels constituting specific image information in the image information MJ that each have a density value of at least the specific threshold value and that overlap with the void image information WJ1. The specific image information indicates for example an image important to a user in the image information MJ. Specifically, in a situation in which the image M is an image of "Diamond Fuji" as illustrated in FIG. 2, the specific image information includes the first sun image information MJ2 and image information representing the mountaintop of Mt. Fuji in the first mountain image information MJ1, for example. In the above case, the direction of the sheet P can be determined so that quality of the image M formed on the sheet P is further favorable. Consequently, quality impairment of the image M formed on the sheet P can be further reduced.

In addition, as described with reference to FIG. 2, the image M is formed on the second sheet P2 when ejection failure in a nozzle occurs in the embodiment of the present disclosure, which should not be taken to limit the present disclosure. It is only required that the image M be formed on a sheet P when ejection failure in a nozzle occurs. For example, the image M may be formed on the first sheet P1 when ejection failure in a nozzle occurs.

In the above case, when a direction indicated by an angle θ of rotation of 0 degrees or 180 degrees is determined as the direction of the sheet P, the first feeding cassette 11 is selected as the feeding cassette 1S. When a direction indicated by an angle θ of rotation of 90 degrees or 270 degrees is determined as the direction of the sheet P, the second feeding cassette 12 is selected as the feeding cassette 1S. In the above configuration, the feeding cassette 1S can be selected according to the direction of the sheet P.

Figure 6:
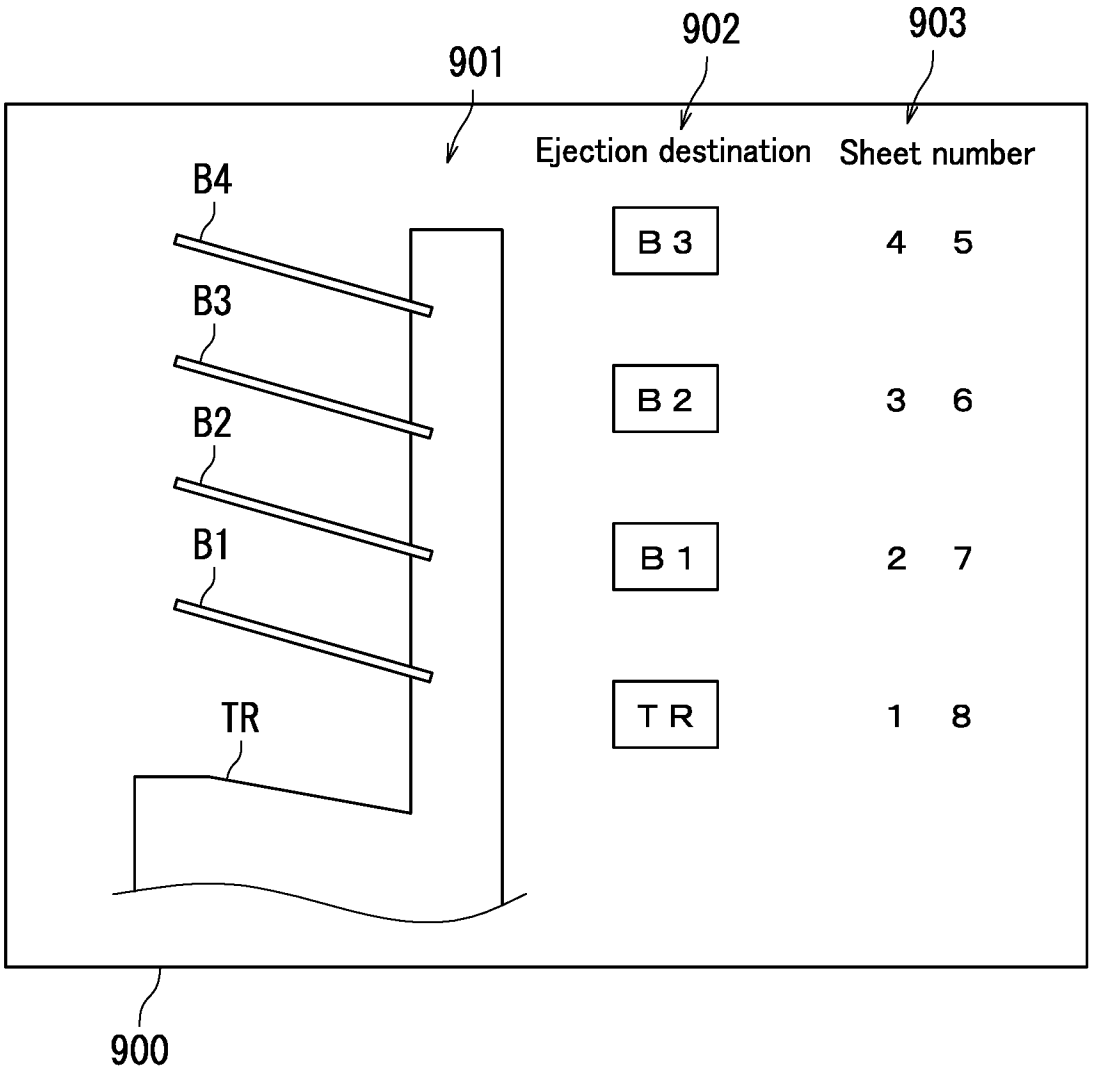
FIG. 6 is a screen diagram illustrating an example of an ejection destination display screen displayed on a touch panel in the inkjet recording apparatus according to the embodiment of the present disclosure.

The following further describes the process performed by the controller 7 with reference to FIGS. 1 to 6. FIG. 6 is a screen diagram illustrating an example of an ejection destination display screen 900 displayed on the touch panel 81. As illustrated in FIG. 6, the ejection destination display screen 900 displays a tray display area 901, an ejection destination display area 902, and a sheet number display area 903. The ejection destination display screen 900 is displayed on the touch panel 81 under control by the display control section 705.

Respective positions of trays are indicated in an image of the inkjet recording apparatus 100 displayed in the tray display area 901. A main tray TR, a first bin B1, a second bin B2, a third bin B3, and a fourth bin B4 are displayed in the tray display area 901. The main tray TR represents the main body exit tray 60 illustrated in FIG. 1. The first bin B1 represents the first exit tray 61 illustrated in FIG. 1. The second bin B2 represents the second exit tray 62 illustrated in FIG. 1. The third bin B3 represents the third exit tray 63 illustrated in FIG. 1. The fourth bin B4 represents the fourth exit tray 64 illustrated in FIG. 1.

The exit tray 6S of the sheet P selected by the ejection control section 704 is displayed in the ejection destination display area 902. Reference signs TR, B1, B2, and B3 that respectively represent the main tray TR, the first bin B1, the second bin B2, and the third bin B3 are displayed in association with the tray display area 901 in the ejection destination display area 902. A reference sign TR represents the main tray TR. A reference sign B1 represents the first bin B1. A reference sign B2 represents the second bin B2. A reference sign B3 represents the third bin B3. Note that no sheet P is ejected onto the fourth bin B4, and therefore, a reference sign representing the fourth bin B4 is not displayed in the ejection destination display area 902.

Sheet numbers of respective sheets P ejected onto any of the main tray TR, the first bin B1, the second bin B2, and the third bin B3 are displayed in the sheet number display area 903. The first sheet and the eighth sheet are ejected on the main tray TR (main body exit tray 60). The second sheet and the seventh sheet are ejected on the first bin B1 (first exit tray 61). The third sheet and the sixth sheet are ejected on the second bin B2 (second exit tray 62). The fourth sheet and the fifth sheet are ejected on the third bin B3 (third exit tray 63).

As described with reference to FIGS. 1 to 6, the display control section 705 causes the touch panel 81 to display information about the sheet P with the image M formed thereon (for example, the sheet number) in association with information indicating one exit tray 6S on which the sheet P is ejected (for example, the reference sign TR, B1, B2, B3, or B4) in the embodiment of the present disclosure. In the above configuration, a user can easily recognize the exit tray 6S to which the sheet P with the image M formed thereon is ejected. Consequently, user convenience can be increased.

Figure 7:
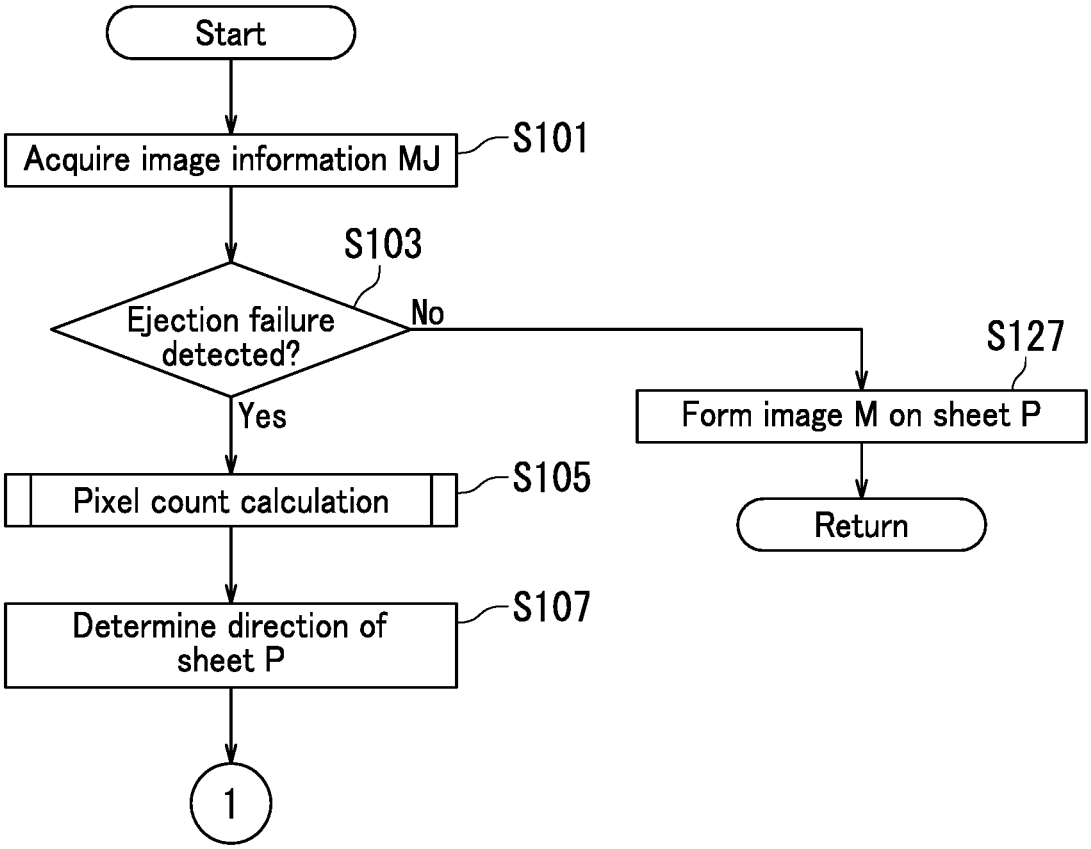
FIG. 7 is a flowchart depicting a former portion of an example of a process that the controller performs in the inkjet recording apparatus according to the embodiment of the present disclosure.
Figure 8:
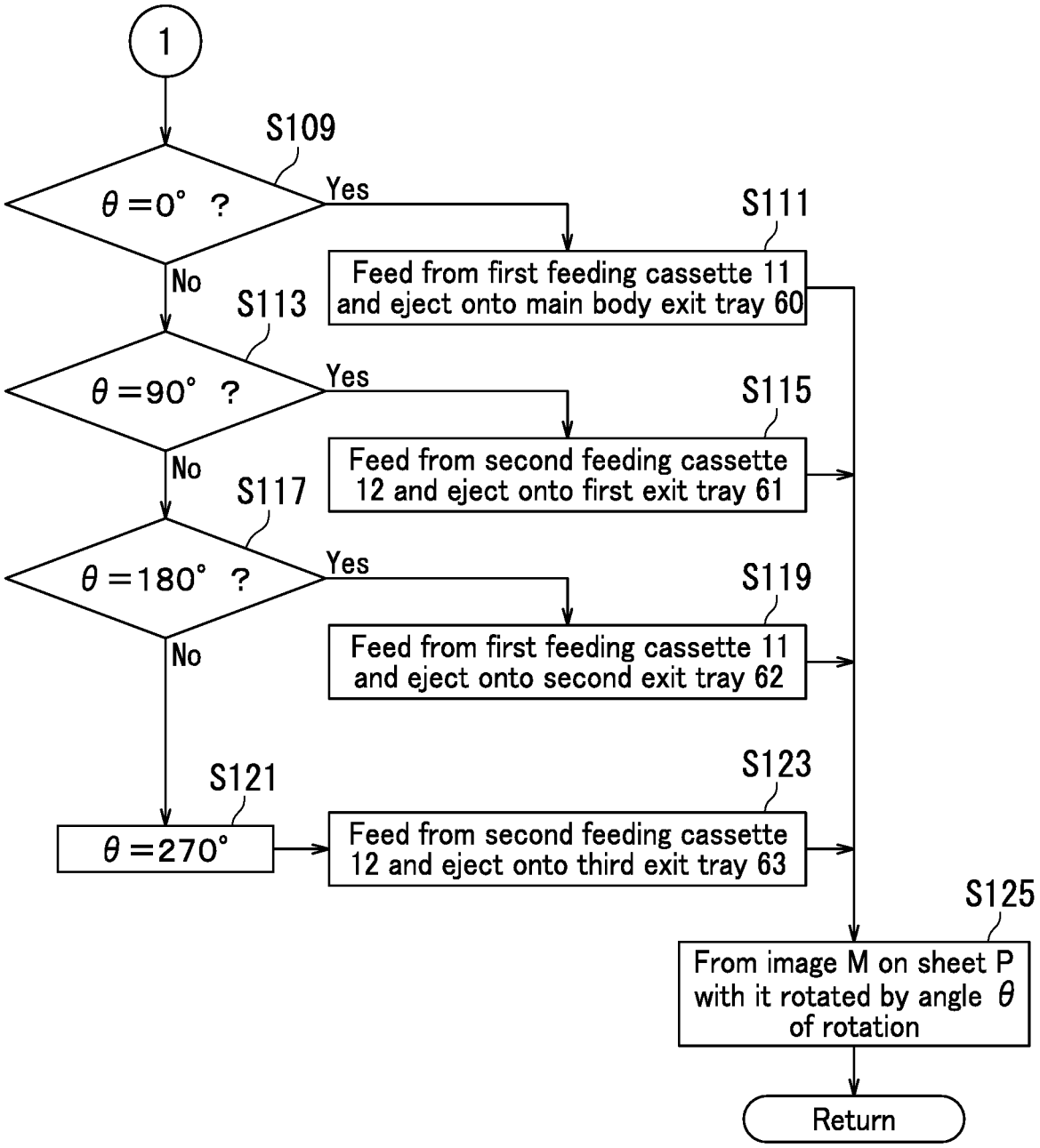
FIG. 8 is a flowchart depicting a latter portion of the example of the process that the controller performs in the inkjet recording apparatus according to the embodiment of the present disclosure.

The following further describes the process performed by the controller 7 with reference to FIGS. 1 to 8. FIG. 7 is a flowchart depicting a former portion of an example of the process that the controller 7 performs. FIG. 8 is a flowchart depicting a latter portion of the example of the process that the controller 7 performs.

As illustrated in FIG. 7, at Step S101, the detection section 701 acquires the image information MJ from the CIS unit 33 illustrated in FIG. 11.

Next at Step S103, the detection section 701 detects whether or not ejection failure in a nozzle occurs based on the image information MJ.

When the detection section 701 detects that no ejection failure in any nozzle occurs (No at Step S103), the routine proceeds to Step S127.

Then at Step S127, the controller 7 controls the image forming section 3 to form the image M on the sheet P and the routine returns to Step S101.

When the detection section 701 detects that ejection failure in a nozzle occurs (Yes at Step S103), the routine proceeds to Step S105.

At Step S105, the calculation section 702 executes "pixel count calculation". The "pixel count calculation" is a process to calculate a pixel count NW of pixels among pixels in the image information MJ representing the image M that correspond to a nozzle for which ejection failure is detected by the detection section 701.

Subsequently, at Step S107, the determination section 703 determines a direction of the sheet P to be fed to the recording head unit 34 based on the pixel count NW. In other words, the determination section 703 determines an angle θ of rotation of the sheet P.

Next, as illustrated in FIG. 8, the controller 7 determines whether or not the angle θ of rotation is 0 degrees at Step S109.

When the controller 7 determines that the angle θ of rotation is 0 degrees (Yes at Step S109), the routine proceeds to Step S111.

At Step S111, the selection section 706 determines feeding of the sheet P from the first feeding cassette 11 and the ejection control section 704 determines ejection of the sheet P onto the main body exit tray 60. Then, the routine proceeds to Step S125.

When the controller 7 determines that the angle θ of rotation is not 0 degrees (No at Step S109), the routine proceeds to Step S113.

At Step S113, the controller 7 then determines whether or not the angle θ of rotation is 90 degrees.

When the controller 7 determines that the angle θ of rotation is 90 degrees (Yes at Step S113), the routine proceeds to Step S115.

At Step S115, the selection section 706 determines feeding of the sheet P from the second feeding cassette 12 and the ejection control section 704 determines ejection of the sheet P onto the first exit tray 61. The routine then proceeds to Step S125.

When the controller 7 determines that the angle θ of rotation is not 90 degrees (No at Step S113), the routine proceeds to Step S117.

At Step S117, the controller 7 then determines whether or not the angle θ of rotation is 180 degrees.

When the controller 7 determines that the angle θ of rotation is 180 degrees (Yes at Step S117), the routine proceeds to Step S119.

At Step S119, the selection section 706 determines feeding of the sheet P from the first feeding cassette 11 and the ejection control section 704 determines ejection of the sheet P onto the second exit tray 62. The routine then proceeds to Step S125.

When the controller 7 determines that the angle θ of rotation is not 180 degrees (No at Step S117), the routine proceeds to Step S121.

At Step S121, the controller 7 then determines that the angle θ of rotation is 270 degrees.

At Step S123, the selection section 706 determines feeding of the sheet P from the second feeding cassette 12 and the ejection control section 704 determines ejection of the sheet P onto the third exit tray 63. The routine then proceeds to Step S125.

At Step S125, the controller 7 then controls the image forming section 3 to form the image M rotated by the determined angle θ of rotation on the sheet P and the routine returns to Step S101.

Figure 9:
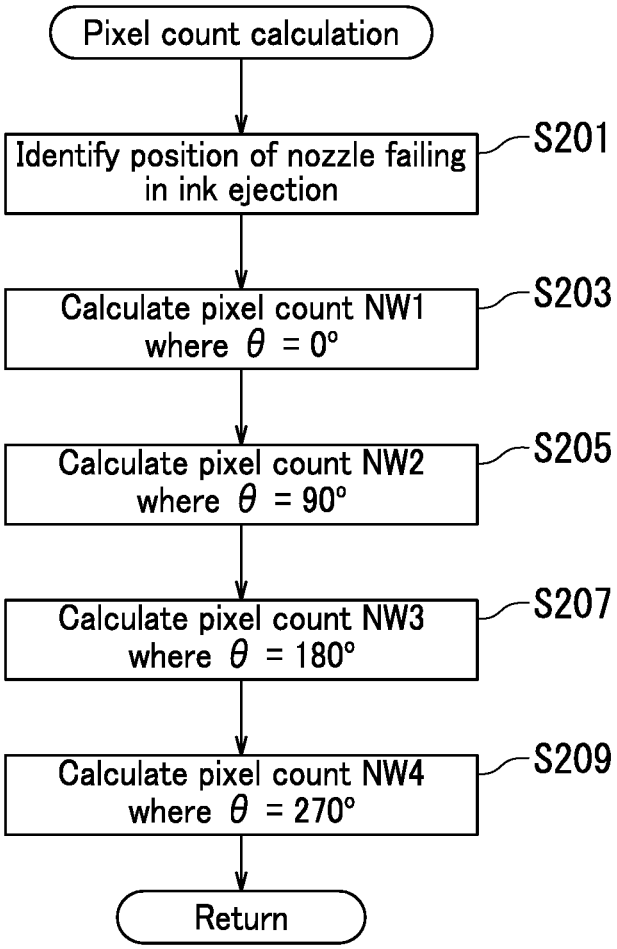
FIG. 9 is a flowchart depicting an example of pixel count calculation that the controller performs in the inkjet recording apparatus according to the embodiment of the present disclosure.

The following describes "pixel count calculation" performed by the controller 7 with reference to FIG. 9. FIG. 9 is a flowchart depicting an example of the pixel count calculation that the controller 7 performs.

At Step S201, the controller 7 first identifies a location of a nozzle failing in ink ejection. Specifically, the controller 7 identifies a location of the nozzle failing in ink ejection in a direction of perpendicular to the conveyance direction D1 of the sheet P.

Next at Step S203, the calculation section 702 calculates the pixel count NW1 under a condition that the angle θ of rotation of the sheet P is 0 degrees.

Next at Step S205, the calculation section 702 calculates the pixel count NW2 under a condition that the angle θ of rotation of the sheet P is 90 degrees.

Next at Step S207, the calculation section 702 calculates the pixel count NW3 under a condition that the angle θ of rotation of the sheet P is 180 degrees.

Next at Step S209, the calculation section 702 calculates the pixel count NW4 under a condition that the angle θ of rotation of the sheet P is 270 degrees. The routine then returns to Step S107 in FIG. 7

As described with reference to FIGS. 1 to 9, ejection failure in a nozzle is detected in the embodiment of the present disclosure. Once ejection failure in a nozzle is detected, a pixel count NW of pixels corresponding to the nozzle for which ejection failure is detected is calculated for each angle θ of rotation (0 degrees, 90 degrees, 180 degrees, and 270 degrees). A direction of the sheet P to be fed to the recording head unit 34 is then determined based on the pixel count NW. In the above configuration, the direction of the sheet P in which the image M is to be formed on the sheet P favorably in quality can be determined in a situation in which ejection failure in a nozzle occurs. Thus, quality impairment of the image M formed on the sheet P can be reduced.

An embodiment of the present disclosure has been described so far with reference to the drawings. However, the present disclosure is not limited to the above embodiment and can be practiced in various manners within a scope not departing from the gist of the present disclosure (for example, as described below in (1) and (2)). The drawings schematically illustrate elements of configuration in order to facilitate understanding. Properties such as thickness and length of elements of configuration illustrated in the drawings, and the numbers thereof may differ from actual properties and the actual numbers thereof in order to facilitate preparation of the drawings. Also, shapes, dimensions, and the like of elements of configuration described in the above embodiment are merely examples and not intended as specific limitations. Various alterations may be made within a scope not substantially departing from the configuration of the present disclosure.

(1) As described with reference to FIG. 1, the number of the recording heads (first to fourth recording head 341 to 344) of the recording head unit 34 is four in the inkjet recording apparatus 100 according to the present embodiment, which should not be taken to limit the present disclosure. It is only required that at least one recording head be included in the inkjet recording apparatus 100. For example, the number of recording heads in the inkjet recording apparatus 100 may be one, two, or three. Alternatively, the number of recording heads in the inkjet recording apparatus 100 may be five or more.

(2) As described with reference to FIGS. 1 and 2, the image M is a monochrome image in the embodiment of the present disclosure, which should not be taken to limit the present disclosure. The image M may be a color image. In a case where the image M is a color image, the detection section 701 detects ejection failure in any of nozzles that eject the yellow ink Ky, nozzles that eject the black ink Kk, nozzles that eject the cyan ink Kc, and nozzles that eject the magenta ink Km. When the detection section 701 detects for example ejection failure in a nozzle that ejects the cyan ink Kc, it is only required that the calculation section 702 calculate a pixel count of pixels for the cyan ink Kc corresponding to the nozzle for which ejection failure is detected by the detection section 701 in the image information MJ representing the image M formed on the sheet P.

What is claimed is:

1. An inkjet recording apparatus comprising:

a recording head including nozzles that eject ink onto a recording medium;

a detection section configured to detect ejection failure in a nozzle among the nozzles;

a determination section configured to determine a direction of the recording medium to be fed to the recording head based on a result of detection by the detection section and an image formed on the recording medium; and a calculation section configured to calculate a pixel count of pixels corresponding to the nozzle for which ejection failure is detected by the detection section among pixels in image information representing the image formed on the recording medium, wherein the calculation section calculates four pixel counts of: a pixel count under a condition that an angle of rotation of the recording medium is 0 degrees; a pixel count under a condition that the angle of rotation of the recording medium is 90 degrees; a pixel count under a condition that the angle of rotation of the recording medium is 180 degrees; and a pixel count under a condition that the angle of rotation of the recording medium is 270 degrees, and the determination section determines as the direction of the recording medium to be fed to the recording head a direction indicating an angle of rotation corresponding to the smallest pixel count of the four pixel counts calculated by the calculation section.

2. The inkjet recording apparatus according to claim 1, further comprising an image information generating section configured to read an image formed on the recording medium and generate image information representing the image read by the image information generating section, wherein the detection section detects ejection failure in the nozzle based on the image information.

3. The inkjet recording apparatus according to claim 2, wherein the image information generating section is disposed downstream of the recording head in a conveyance direction of the recording medium.

4. The inkjet recording apparatus according to claim 1, further comprising:

a plurality of exit trays onto any of which the recording medium with the image formed thereon is placed; and an ejection section configured to eject the recording medium with the image formed thereon onto any one exit tray of the exit trays according to the direction of the recording medium determined by the determination section.

5. The inkjet recording apparatus according to claim 4, further comprising:

a display; and a display control section configured to cause the display to display information indicating the recording medium with the image formed thereon in association with information indicating the one exit tray onto which the recording medium is ejected.

6. The inkjet recording apparatus according to claim 1, further comprising:

a plurality of feeding trays onto each of which the recording medium to be fed to the recording head is loaded;

a conveyance section configured to convey the recording medium to the recording head in a conveyance direction of the recording medium; and a selection section configured to select one tray from among the feeding trays, wherein the feeding trays include a first tray and a second tray that differs from the first tray, when the determination section determines as the direction of the recording medium a direction corresponding to an angle of rotation of 0 degrees or 180 degrees, the selection section selects the first tray, when the determination section determines as the direction of the recording medium a direction corresponding to an angle of rotation of 90 degrees or 270 degrees, the selection section selects the second tray, and an angle between a direction of the recording medium fed to the recording head from the second tray and a direction of the recording medium fed to the recording head from the first tray is 90 degrees.

* * * * *